United States Patent [19]

Laufer

[11] 3,946,713

[45] Mar. 30, 1976

[54] RPM REGULATOR FOR FUEL INJECTION PUMPS

[75] Inventor: Helmut Laufer, Stuttgart, Germany

[73] Assignee: Robert Boach GmbH, Stuttgart, Germany

[22] Filed: Sept. 26, 1974

[21] Appl. No.: 509,676

[30] Foreign Application Priority Data

Oct. 3, 1973 Germany ..... 2349553

[52] U.S. Cl. 123/139 AD; 123/139 AF; 123/139 BD; 123/140 FG; 417/294

[51] Int. Cl.[2] ..... F02D 1/04; F02M 59/24

[58] Field of Search..... 123/140 R, 140 A, 140 FG, 123/139 BD, 139 AP, 139 AD, 139 AR, 139 AB, 139 AF, 139 AA, 139 AC; 417/282, 289, 294

[56] References Cited

UNITED STATES PATENTS

| | | | |
|---|---|---|---|
| 2,107,070 | 2/1938 | Fleury | 123/140 R X |
| 2,815,741 | 12/1957 | Fancher et al. | 123/139 AP |
| 3,234,927 | 2/1966 | Cramer, Jr. | 123/140 R |

FOREIGN PATENTS OR APPLICATIONS

| | | | |
|---|---|---|---|
| 409,807 | 5/1934 | United Kingdom | 123/139 AP |
| 1,287,852 | 1/1969 | Germany | 123/140 R |

*Primary Examiner*—Charles J. Myhre
*Assistant Examiner*—Tony Argenbright
*Attorney, Agent, or Firm*—Edwin E. Greigg

[57] ABSTRACT

An improved rpm regulator for a fuel injection pump associated with an internal combustion engine. The regulator includes a suction chamber, an intermediate lever, a fuel quantity control sleeve connected to the intermediate lever, a regulating spring assembly connected to the intermediate lever, a device including centrifugal weights and a governor sleeve for developing and transmitting an rpm signal through the intermediate lever to the fuel quantity control sleeve in opposition to a force exerted by the regulating spring assembly, a control lever, and an adjustable stop, including a cam member, mounted to the housing for limiting the motion of the intermediate lever. A working chamber is provided between the governor sleeve and an end of a guide shaft forming part of the device for transmitting an rpm signal. Openings are provided in the governor sleeve which communicate with the suction chamber for effecting a damping of oscillations of the governor sleeve during predetermined load conditions.

4 Claims, 9 Drawing Figures

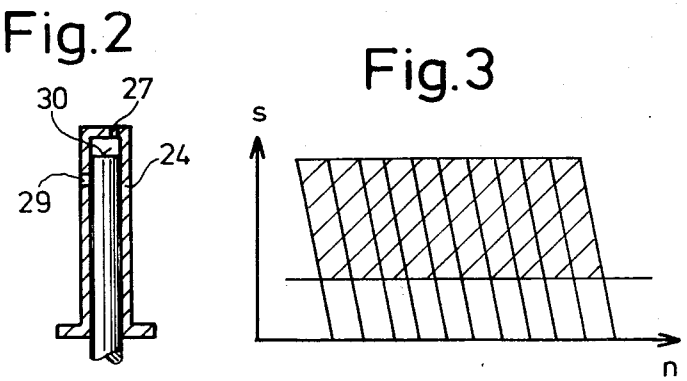
Fig.2
Fig.3
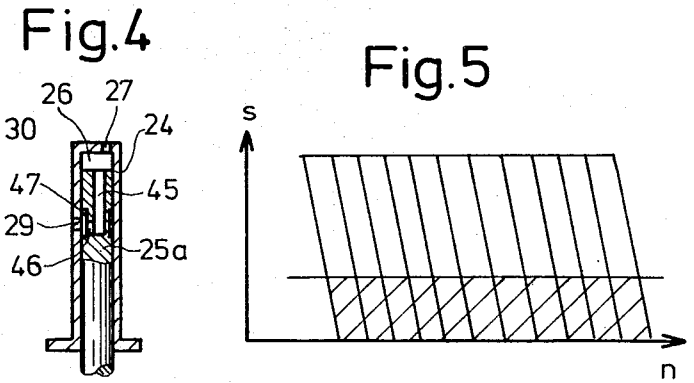
Fig.4
Fig.5
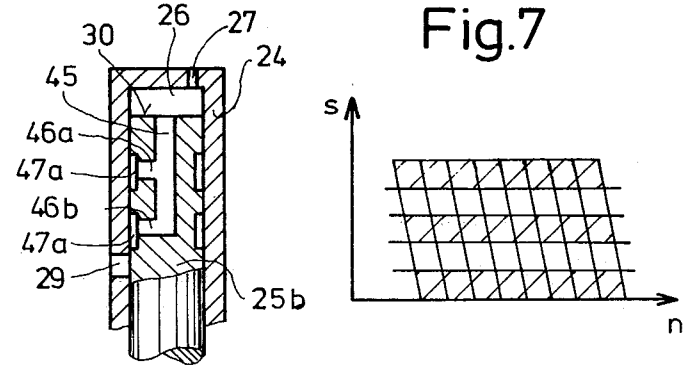
Fig.6
Fig.7
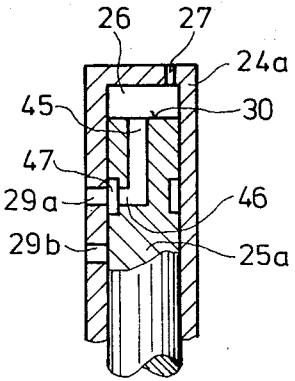
Fig.8
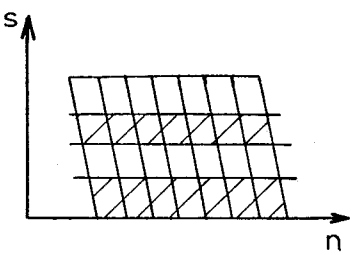
Fig.9

RPM REGULATOR FOR FUEL INJECTION PUMPS

BACKGROUND OF THE INVENTION

This invention relates to an rpm regulator for fuel injection pumps associated with internal combustion engines of the type having an intermediate lever pivotably mounted about a shaft to which a fuel quantity control sleeve is coupled and a centrifugally operated device for generating an rpm signal and applying a corresponding force against the force of a regulator spring assembly to the intermediate lever and thereby to the fuel quantity control sleeve. The present invention relates, more particularly, to such an rpm regulator in which the centrifugally operated device is positioned in the suction chamber of the pump, the chamber being filled with fuel. The device for developing and transmitting an rpm signal includes an axial guide shaft of a centrifugal regulator and the displaceable governor sleeve. The frontal end of the governor sleeve is in contact with the intermediate lever and acts against an arbitrarily alterable force of the regulating spring assembly. Fuel quantity fed by the injection pump is determined by the position of the intermediate lever, the volume of the working chamber being varied with simultaneous fuel delivery through a throttle aperture connecting the working chamber with the suction chamber.

In known rpm regulators of such type the frontsided closed governor sleeve of the centrifugal regulator is displaced by action of centrifugal weights which are mounted about a guide shaft. The governor sleeve has a throttle bore on the frontal end, through which a working chamber, located between the guide shaft and the governor sleeve is connected with the suction chamber. When a volume change in the working chamber occurs because of displacement, the fuel is advanced through the throttle bore and thereby the adjusting motion of the regulator sleeve is damped. Consequently, damping is achieved which is effective over the entire rpm range in this prior art arrangement. Each type of a fuel engine, however, has an rpm or a load range at which it is especially sensitive to detrimental, mechanical, interruptive, nuisance oscillations which influence undesirably the control of the fuel injection quantities. The rpm and load ranges often differ only because of small structural changes in different types of internal combustion engines. According to the type of use to which the particular internal combustion engine is to be put, for example, for the propulsion of a vehicle or of a generator, it may be necessary or desirable to provide for a specific damping characteristic range or ranges, related to a particular load range for the rpm regulator of a fuel injection pump.

The critical range, at which the governor sleeve should not be damped but over which the full, fast-acting speed control of the regulator should be used, is the lowest load range, i.e. the idle range of internal combustion engines, such as those which are specifically designated for the propulsion of motor vehicles. The same is true, in other instances, for the highest load and final rpm range in internal combustion engines which are designated, for example, specifically for driving generators. In an internal combustion engine designated to drive a motor vehicle, it may happen that due to sluggishness of the regulator during a desired fast reduction in rpm, among other things, the internal combustion engine goes into a lower than desired preadjusted rpm range. This so called undercutting or overshooting must be corrected as soon as possible by means of a regulator since otherwise during idling, in an unfavorable case, due to the low drive rpm moment, the internal combustion engine may undesirably come to a standstill. Damping in this range would slow down the regulating velocity and would cause undercutting with detrimental consequences. On the other hand, the top load range of an internal combustion engine used in such a way has a relatively high non-uniformity characteristic, and can be damped substantially without disadvantage. Should the internal combustion engine, for example, be revved to the uppermost rpm range by a sudden acceleration, then the large non-uniformity degree is sufficient, even during damping, to obtain a fast control before overreaching of the maximum desired rpm.

On the other hand, when the internal combustion engine is used for driving a generator, then the fuel injection pump has the lowest possible non-uniformity range for maintaining the given rpm as exact as possible under variable loads of the generator. Here, damping in the upper load range is undesirable for such internal combustion engines, because the regulator must correct the rpm deviation as soon as possible.

OBJECT AND SUMMARY OF THE INVENTION

The principal object of the present invention is to provide an rpm regulator for a fuel injection associated with an internal combustion engine in which effective damping of the control function is achieved over a predetermined load range or ranges.

The foregoing object, as well as others, is achieved in a regulator of the type with which the present invention is concerned by providing that a governor sleeve associated with an axial guide shaft of a centrifugal regulator encloses a working chamber having a connection through the throttle bore or aperture arranged on the governor sleeve, at least one other aperture, the opening of which is determined by the instant position of the governor sleeve, defines a bypass connection to a suction chamber. Thereby, in an advantageous manner, a possibility is achieved to switch off the effectiveness of the throttle aperture by controlling the relief bypass connection, so that in a particular load range, which is determined by the corresponding position of the governor sleeve, damping is achieved to the exclusion of damping in at least one other load range.

A further preferred embodiment of the invention provides that the bypass connection is developed as a relief aperture, in the cylindrical wall of the governor sleeve, controlled by the axial guide shaft of the centrifugal regulator. In this manner, the control of the bypass connection and the manufacture thereof is achieved in the most simple way.

Another novel embodiment provides that the relief aperture is controlled by at least one sleeve groove, which communicates with the working chamber through a traverse bore and a longitudinal bore in the axial guide shaft.

In this manner a regulated damping over a plurality of separated predetermined load ranges may be achieved.

A particularly favorable embodiment of the present invention provides that the relief aperture is controlled by the frontal surface of the axial guide shaft. This enables the damping over the uppermost load range in a very simple and effective manner, and without great expenditures.

BRIEF DESCRIPTION OF THE DRAWING

Several examples of an improved rpm regulator according to the present invention are shown in the drawing and described hereinbelow.

FIG. 2 is a sectional view of the principal novel main portion of the first embodiment of FIG. 1;

FIG. 3 is a graphical representation of a set of characteristic curves for an internal combustion engine equipped with the novel regulator of FIGS. 1 and 2;

FIG. 4 is a sectional view of the novel principal portion of a second exemplary embodiment of an rpm regulator, its governor regulator sleeve being positioned on the axial guide shaft of a centrifugal regulator;

FIG. 5 is a graphical representation of a set of characteristic curves for an internal combustion engine equipped with a novel regulator which includes the arrangement of FIG. 4;

FIG. 6 is a sectional view of the novel main portion of a third exemplary embodiment of the rpm regulator according to the present invention;

FIG. 7 is a graphical representation of a set of characteristic curves for an internal combustion engine equipped with a novel regulator which includes the arrangement of FIG. 6;

FIG. 8 is a sectional view of the main novel portion of a fourth exemplary embodiment of an rpm regulator according to the present invention; and FIG. 9 is a graphical representation of a set of characteristic curves for an internal combustion engine equipped with a novel regulator which includes the arrangement of FIG. 8.

DETAILED DESCRIPTION OF THE PREFERRED EMBODIMENTS

Figure 1:
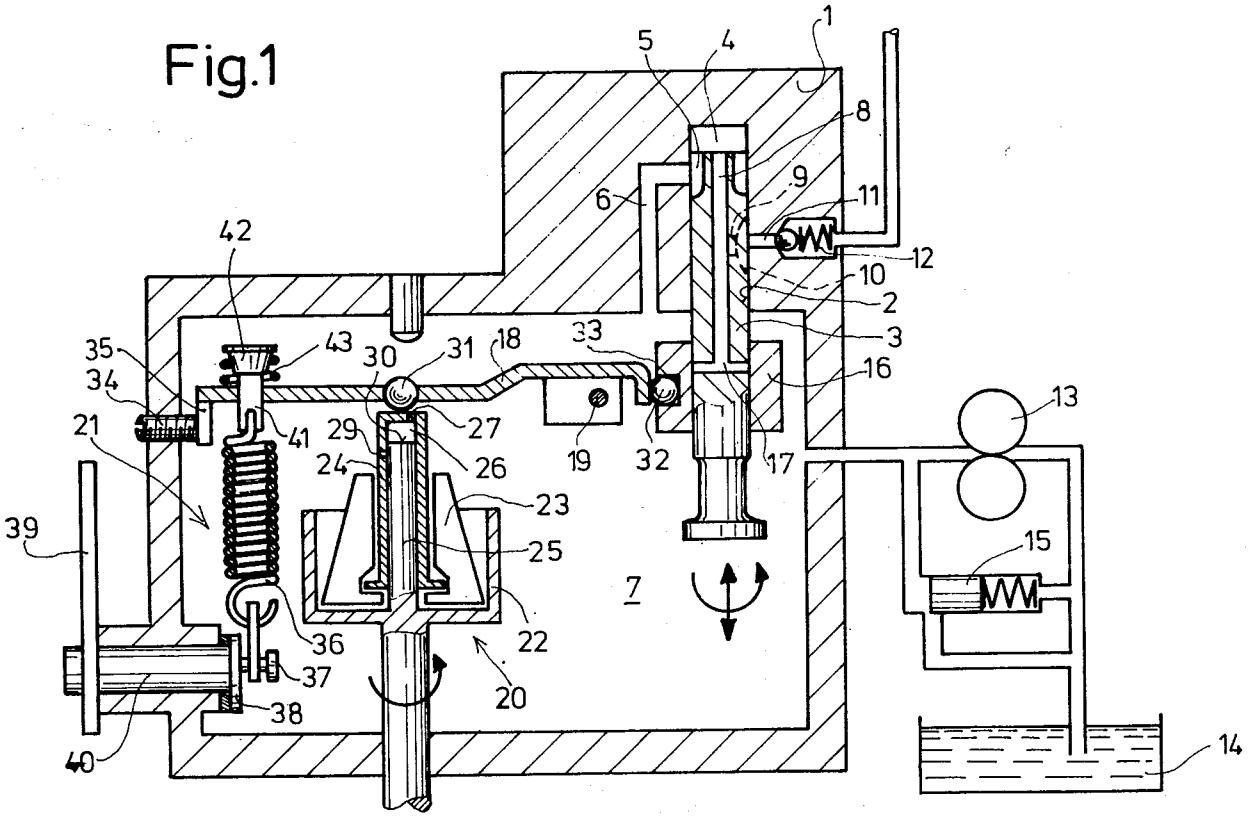
FIG. 1 is a somewhat simplified sectional view of the fuel injection pump, in schematic representation, combined with a first exemplary embodiment of a novel rpm regulator constructed according to the present invention.

As illustrated in FIGS. 1–3, an embodiment of an rpm regulator includes a housing 1 of a fuel injection pump having a bore 2 within which a pump piston 3 is set for simultaneous rotating and reciprocating motion by conventional means (not shown) against a force provided by a return spring (not shown). The bore 2 and piston 3 define a pump working chamber 4. The pump working chamber 4 is supplied with fuel through a respective one of a plurality of longitudinal grooves 5 provided in the outer cylindrical face of the pump piston 3 and a bore 6 traversing the housing 1 and leading from a suction chamber 7. The fuel is supplied to the working chamber 4 during the suction strokes of the piston 3 and while it occupies its bottom dead-center position. During the pressure stroke of the piston 3 and upon a corresponding rotation of the piston 3, the bore 6 is closed, or hydraulically disconnected from the grooves 5. Under these conditions, the fuel present in the pump working chamber 4 is fed to a longitudinal bore 8 in the piston 3. From the longitudinal bore 8 the fuel is further fed through a branching-off radial bore 9 and a longitudinal distributing groove 10, both formed in the wall of the pump piston 3, to one of several pressure conduits 11. From the respective conduits 11, the fuel is forced past a check valve 12 and discharged into a corresponding bore which leads to a corresponding fuel injection valve (not shown) of the internal combustion engine. There are, of course, as many conduits 11 and corresponding bores, distributed about the circumference of the housing 1, as cylinders of the internal combustion engine.

The suction chamber 7 is provided with fuel through a delivery pump 13 from the fuel tank 14. The pressure in the suction chamber 7 is regulated in accordance with rpm by means of a pressure control valve 15 in a manner known per se so that when the rpm increases, the pressure in the suction chamber 7 also increases.

The piston 3 is provided with a slidable annular control sleeve 16 which controls, during the pressure stroke, the extent to which a radial bore 17 will open and thereby determine the ending of a fuel delivery period, and thus the delivered fuel quantity. This control effects the returning of excess fuel from the working chamber 4 back into the suction chamber 7.

The control sleeve 16 is displaced by an intermediate lever 18 which pivots about a pivotal axis defined by a shaft 19.

A centrifugal governor 20 serving as an rpm signal generator acting on the intermediate lever 18 works against the force of a regulator spring assembly 21. The centrifugal governor 20 is driven by conventional driving means (not shown) according to the rpm of the piston 3, with which the regulator is coupled by conventional motion transfer means (not shown). The governor 20 has a carrier 22 on which there are arranged centrifugal weights 23. The centrifugal weights 23 are acted upon by centrifugal force and displace a governor sleeve 24 which contacts the intermediate lever 18 and acts against the force of the regulator spring assembly 21. The governor sleeve 24 is closed on its frontal side positioned opposite the intermediate lever 18 and is sealingly slidable by the centrifugal weights 23 on an axial guide shaft 25, which is an extension of the drive shaft of the centrifugal governor. However, the guide member may also be a fixedly positioned shaft if the centrifugal weight carrier 22 for the weights were driven by gears. Between the guide shaft 25 and the governor sleeve 24 there is a confined working chamber 26 which is connected through a throttle aperture 27, at the closed end of the governor sleeve 24, with the suction chamber 7. The working chamber 26 further has a bypass connection to the suction chamber 7 in the shape of a relief aperture 29 in the cylindrical wall of the governor sleeve 24. The relief aperture 29 is closed by the guide shaft 25 as long as the governor sleeve 24 is in its starting position shown in FIG. 1. Upon a certain control of the governor sleeve 24 against the force of the regulating spring assembly 21, the relief aperture 29 is opened through the frontal edge 30 of the guide shaft 25.

In order to have a substantially frictionless and momentum-free transfer of movement of the centrifugal governor, the governor sleeve 24 engages the intermediate lever 18 via a sphere 31 installed in the intermediate lever 18 opposite the upper end of the guide shaft 25. The intermediate lever 18 is provided with a spherical head 32 at the end adjacent to the control sleeve 16, the spherical head 32 interlocks in the complemental depression 33 provided in the control sleeve 16. During the reciprocal movement of the intermediate lever 18, the control sleeve 16 is axially displaced on the piston 3 and thereby the timing is also changed upon opening the traverse bore 17 during the pressure stroke movement of the piston 3 and thereby the fuel feed into the pressure conduits 11 is interrupted. The further up the control sleeve 16 is displaced, the greater is the fuel quantity fed by the injection pump. A displaceable full load stop member 34 is provided for limiting the pivotal movement of the intermediate lever 18. Preferably the stop member is a screw with a cam 35 at one end. When the maximum permissible feed quantity is reached, movement of the intermediate lever 18 is stopped by the cam 35 carried by the stud 34. The cam, being rotatable by the threaded stud 34, can be adjusted to fix the stud stopping point.

The closure of the control sleeve 16 by the intermediate lever 18 is also controlled by the regulator spring assembly 21 in addition to the centrifugal governor 20. This regulating spring assembly 21 includes a tensioning spring 36 fastened at one end by a bolt 37 to a lever 38, which lever 38 is actuated by a control lever 39 and an interconnecting shaft 40 for the purpose of alterably setting the pre-tensioning of the spring 36. At the other end of the spring 36 there is suspended a coupling member 41 to which the tensioning spring 36 is connected. The coupling member 41 extends through an aperture in the intermediate lever 18 and has a head 42. The head 42 is provided with an idling spring 43 disposed about the head 42 and between the head 42 and the intermediate lever 18. The idling spring 43 functions together with the centrifugal governor 20 in the idling range and during the rpm increase or during the change of pretension on the regulating spring assembly 21. The idling spring 42 is compressed so far that the head 42 abuts the upper surface of the intermediate lever 18; thereupon only the tensioning spring 36 is operative.

In FIG. 2 the governor sleeve 24 is more clearly shown, its operation being set out below, reference also being made to other parts not shown in FIG. 2, but shown in FIG. 1.

At a high load, i.e., at high pre-tension of the regulating spring assembly 21, according to a full load adjustment on the control lever 39, the centrifugal weights 23 are not in the position to displace the governor sleeve 24 on the axial guide shaft 25 or to oscillate the intermediate lever 18. Only upon reaching a predetermined desired rpm are the centrifugal weights 23 displaced sufficiently enough to effect the position of the governor sleeve 24, thereby effecting a reduction of the fuel feed quantity. The rpm regulator regulates down. On the other hand, in the upper partial load range, at a lesser regulator spring pre-tension, the governor sleeve 24 can be displaced, whereby its movements, especially those which are caused by interference influence, are damped in such a manner that during every position movement the fuel must flow through the throttle aperture 27. From a certain control level onward, the frontal surface 30 of the driving shaft 25 releases the relief opening 29 so that from this point on no more throttling occurs between the working chamber 26 and the suction chamber 7 of the to-and-fro flowing fuel quantities. Thus, no more damping of the governor sleeve 24 occurs.

In FIG. 3 is a graphical representation of a set of characteristic curves of an internal combustion engine equipped with the above described injection pump. The curves show the control path S of the control sleeve 16 as a function of rpm and at various load conditions. The upper horizontal line corresponds to the full-load condition. The cross hatched area represents the damped load region. The non-cross-hatched area represents the undamped load region, the actual transition not in actual practice being as abrupt as the solid line beneath the cross-hatched area implies. Since the oscillations are primarily nuisance oscillations, an increasingly greater proportion of the half-waves of these oscillations is damped in the transition region between the damped and undamped regions shown in FIG. 3.

While the development of the governor sleeve 24, according to FIG. 2, effects damping in the upper load range, as can be seen from FIG. 3, it is possible to obtain damping in the lower load range as may be seen from the corresponding diagram in FIG. 5, showing a set of characteristic curves of an internal combustion engine equipped with an injection pump having a governor sleeve arrangement as shown in FIG. 4.

In the exemplary embodiment of FIG. 4, an axial guiding shaft 25*a* of a centrifugal governor has an axial deadend bore 45 opening from a working chamber 26, which bore 45 is connected to a groove 47 in the outer surface of the guide shaft 25*a*, via a transverse bore 46. In the illustrated position of a governor sleeve 24, a relief aperture 29 opens into the groove 47. In displacing the governor sleeve 24, while the relief aperture 29 remains in communication with the groove 47, the damping does not take place. Only when, by virtue of a further displacement, corresponding to a lower load condition, the relief aperture 29 is closed, the volumetric fluctuations of a working chamber 26, caused by the oscillating movements of the governor sleeve 24, are compensated for through a throttle aperture 27, which effects a damping of the governor sleeve 24.

The exemplary embodiment of FIG. 6 shows a possibility with which several separated load ranges within one overall range may be provided with damping, the damped load ranges being graphically represented by the cross-hatched areas of FIG. 7. As an exemplary embodiment of FIG. 4, the guide shaft 25*b* has also an axial dead end bore 45 opening from a working chamber 46, from which two traverse bores 46*a*, 46*b* lead respectively into respective sleeve grooves 47*a*, 47*b* in the outer surface of the guide shaft 25*b*. A relief aperture 29 is provided, this aperture corresponding to that shown in the governor sleeve 44 (FIG. 4), but in the embodiment of FIG. 6 the outlet position may be closed, as in the arrangement shown in FIG. 2. This would produce a damping of the topmost load region as long as the relief aperture 29 is not connected with the sleeve groove 47*b* due to displacement of the governor sleeve 24. During further displacement of the governor sleeve 24, in accordance with the decreasing load, the relief bore 29 may come into communication with the sleeve groove 47*b*, thereafter be closed again, then come into communication with the sleeve groove 47*a* and thereafter be closed again. In this manner in the spaced damping regions, illustrated in FIG. 7 by the cross-hatched areas, certain load range conditions are achieved, which are extremely low, extremely high and of a limited range, separate from both the other damped ranges.

In the exemplary embodiments of FIGS. 4 and 6 a further gradation can be achieved in that a frontal edge 30 of the guide shaft 25*a* or 25*b* is additionally used as the controlling edge for the relief bore 29. It is obvious from the exemplary embodiment of FIG. 6 that, even at starting position of the governor sleeve 24, the relief aperture 29 can be in communication with the sleeve groove 47*b* and thus the topmost load range is not checked.

The embodiment of FIG. 8 shows an alternative solution for the characteristics sought to be achieved by the exemplary embodiment of FIG. 6. In this case a guide shaft 25*a* is similarly developed as the guide shaft 25*a* of FIG. 4, but it possesses a governor sleeve 24*a* having two relief bores 29*a*, 29*b* which are controlled via a sleeve groove 47. FIG. 9 also shows by cross-hatching the damping associated with particular load ranges within an overall range, the non-cross-hatched areas in FIG. 8 denoting the undamped ranges of the governor sleeve 24*a*. Thus, the governor sleeve 24*a* is not damped in the uppermost range and in a range above the lowest most range, and is damped in the lowermost range and over a range separated therefrom.

By means of the above-described exemplary embodiments of the invention the rpm regulator of an internal combustion engine, actuated by an injection pump, can be damped in a simple manner over different, predetermined load ranges.

Nuisance oscillations may thereby be eliminated which, particularly in these ranges, may cause damage to the parts and/or a faulty control.

It is to be appreciated that the foregoing description and accompanying illustrations are set out by way of example, not by way of limitation. Numerous other embodiments and variants are possible within the scope and spirit of the invention, the scope being defined in the appended claims.

What is claimed is:

1. In an rpm regulator for use with a fuel injection pump associated with an internal combustion engine, said regulator including a housing within which a suction chamber is defined, an intermediate lever, a regulating spring means coupled to the intermediate lever, a guide shaft, a centrifugally operating governor sleeve positioned about the guide shaft and having its front end adjacent the intermediate lever for transmitting an rpm signal to the intermediate lever in opposition to a force exerted by the regulating spring means, and a working chamber defined by a space between an end of the guide shaft and the inside surface of the governor sleeve, the improvement comprising:

a. a throttle aperture formed in the wall of the governor sleeve for providing fluid communication between the working chamber and the suction chamber; and b. at least one controllable relief bypass means connected to the governor sleeve for providing selective fluid communication between said working chamber and said suction chamber over a portion of the relative positional range of said governor sleeve with respect to said guide shaft whereby damping is effective over a predetermined load range.

2. An improved rpm regulator according to claim 1, wherein said bypass means comprises at least one controllable relief aperture formed in the wall of said governor sleeve, relative axial movement between said guide shaft and said governor sleeve selectively closing said relief aperture under predetermined load conditions.

3. An improved rpm regulator according to claim 2, wherein the guide shaft includes a longitudinal bore leading from said working chamber, at least one groove in the outer cylindrical surface of said guide shaft and a bore connecting said groove to said longitudinal bore, and wherein said relief aperture is controlled via said groove.

4. An improved rpm regulator according to claim 2 wherein the guide shaft has a frontal edge, and wherein said relief aperture is controlled by the frontal edge of said guide shaft.

* * * * *